US008152573B2

(12) United States Patent
Bauer et al.

(10) Patent No.: US 8,152,573 B2
(45) Date of Patent: Apr. 10, 2012

(54) ELECTRICAL CONNECTOR WITH A LUG ROTATIONALLY COUPLED TO A BASE HAVING AN APERTURE FOR MOUNTING TO A BASE BOARD

(75) Inventors: David Bauer, Lombard, IL (US); Ron Farber, West Chicago, IL (US)

(73) Assignee: Rotational Lug Technologies, West Chicago, IL (US)

( * ) Notice: Subject to any disclaimer, the term of this patent is extended or adjusted under 35 U.S.C. 154(b) by 0 days.

(21) Appl. No.: 13/087,461

(22) Filed: Apr. 15, 2011

(65) Prior Publication Data

US 2011/0256783 A1 Oct. 20, 2011

Related U.S. Application Data

(60) Provisional application No. 61/324,644, filed on Apr. 15, 2010.

(51) Int. Cl.
*H01R 4/36* (2006.01)
*H01R 11/01* (2006.01)

(52) U.S. Cl. ..... 439/782; 439/810

(58) Field of Classification Search ..... 439/716, 439/727, 777, 782, 810
See application file for complete search history.

(56) References Cited

U.S. PATENT DOCUMENTS

| | | | | |
|---|---|---|---|---|
| 3,191,140 | A * | 6/1965 | Coldren | 439/782 |
| 5,145,415 | A * | 9/1992 | Doudon | 439/620.34 |
| 5,476,397 | A * | 12/1995 | Leff et al. | 439/727 |
| 6,146,213 | A * | 11/2000 | Yoon | 439/716 |
| 6,168,470 | B1 * | 1/2001 | Ikeda et al. | 439/620.08 |
| 6,338,658 | B1 | 1/2002 | Sweeney | |
| 7,056,163 | B2 * | 6/2006 | Hay | 439/810 |
| 7,942,679 | B1 * | 5/2011 | Gretz | 439/108 |

* cited by examiner

*Primary Examiner* — Chandrika Prasad
(74) *Attorney, Agent, or Firm* — Factor Intellectual Property Law Group, Ltd.

(57) ABSTRACT

An electrical connector with a base and a lug rotationally coupled to the base with a bolt having an integral compression washer. The lug and the base have complementary gear faces. A set screw in the lug has a threaded shaft and a head with a projecting hexagonal configuration. The lug can be rotated so as to receive a relatively large gauge wire.

16 Claims, 3 Drawing Sheets

FIG. 5
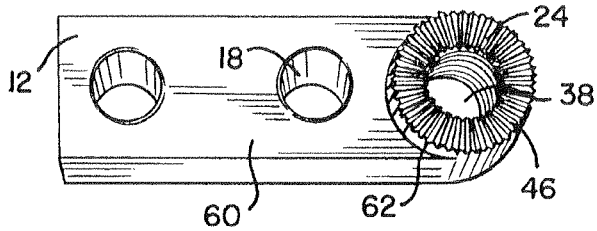
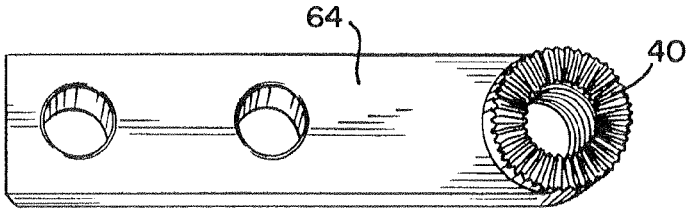
FIG. 6
FIG. 7
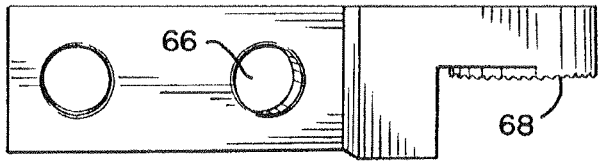
FIG. 8
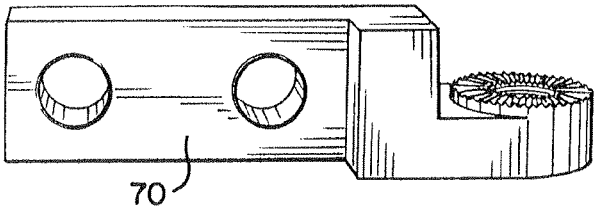
FIG. 9
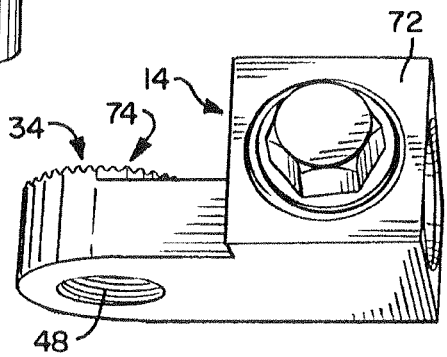
FIG. 10
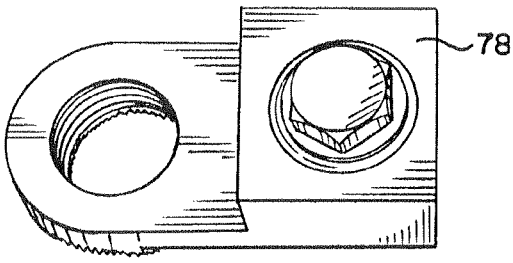
FIG. 11
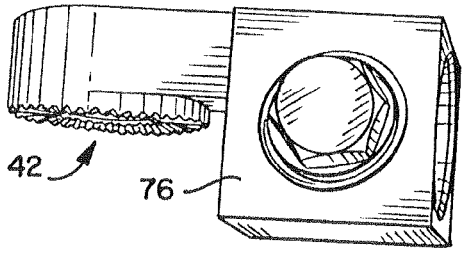

FIG. 12
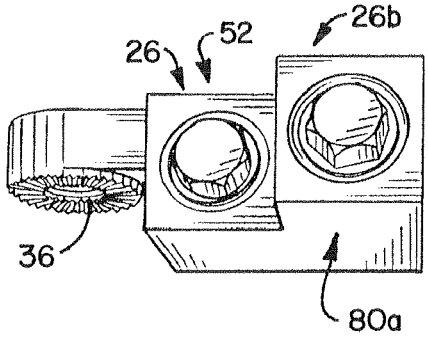
FIG. 13
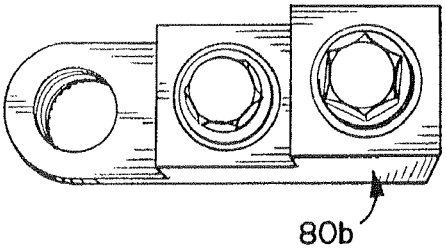
FIG. 14
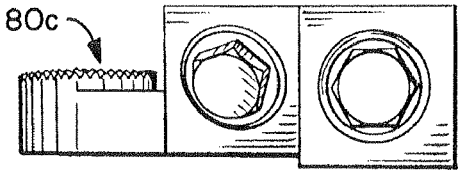
FIG. 15
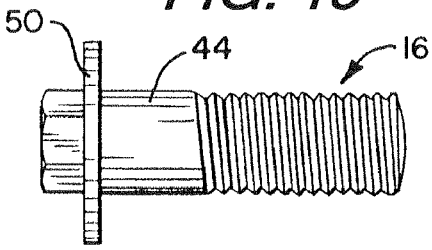
FIG. 16
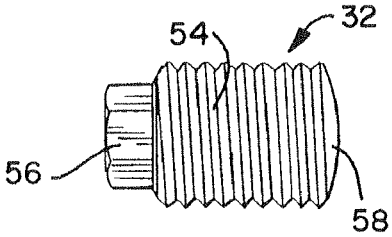
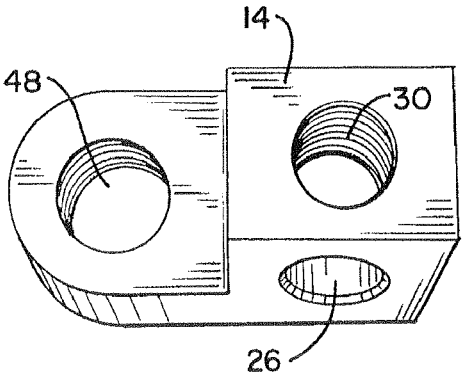
FIG. 17

ELECTRICAL CONNECTOR WITH A LUG ROTATIONALLY COUPLED TO A BASE HAVING AN APERTURE FOR MOUNTING TO A BASE BOARD

RELATED APPLICATIONS

This application claims priority to U.S. Provisional Application No. 61/324,644 filed on Apr. 15, 2010, the entirety of which is incorporated herein by reference.

TECHNICAL FIELD

The present invention relates, in general, to an electrical connector used to connect relatively large gauge electrical wires to bus boards.

BACKGROUND

Electrical connectors are commonly used to terminate an electrical conductor for the purpose of electrically connecting the connector/conductor to an electrical device or to a different electrical conductor. A conventional electrical connector used to couple a wire to a bus board generally comprises a solid electrically-conductive metal body with a set screw for retaining the wire. In applications where the wire has a relatively small gauge, getting the wire to the electrical connector on the bus board does not take much time or effort, as it can easily be bent.

However, in applications utilizing wires having a relatively large gauge, such as 600 MCM wire, it is a costly and time consuming procedure to securely connect the wire to the electrical connector, which is secured to a bus board. One such connector is depicted and described in U.S. Pat. No. 6,338,658. While such a connector is satisfactory for coupling the wire to the bus board, there remain some problems associated with coupling such large wires to bus boards using these types of connectors.

The large wires are directed towards the bus boards from a plurality of different directions. This requires the wire to be bent so that it can be inserted into an aperture of the connector at the appropriate angle. However, given the gauge of the wire, the act of bending can consume significant amounts of time and resources.

In addition, the resulting bend in the wire puts unnecessary strain on the nonconductive coating surrounding the wire. This can lead to weaknesses in the coating—which could lead to failure, resulting in exposing the conductive wire inside of the coating.

Further, if any mistakes are made in the bend (e.g., the wire is over bent), replacing the wire is very costly. Moreover, correcting the improper bend (by cutting the wire or re-bending the wire) may create weaknesses in the system and potential failure points.

In addition to the above problems that may arise using a conventional electrical connector with large gauge wire, many of the conventional electrical connectors utilize a set screw that has an inset hexagonal head. In other words, the set screw head receives a tool therein. However, in some configurations, electrical connectors may be positioned on a bus board such that engaging and tightening the set screw proves to be difficult—especially if the set screw requires a tool to be inserted therein for rotating same.

Accordingly, it would be beneficial to have an electrical connector that solves one or more of these draw backs.

BRIEF SUMMARY

In order to address one or more of these problems, the present invention provides an electrical connector having a base for mounting on a bus board, and a lug for receiving a wire, wherein the lug is rotationally coupled to the base. While embodiments of the present invention are described in relation to 600 gauge wire, it is contemplated that the present invention could be used in association with wires having a similarly large gauge, or any wire wherein the bending of same is problematic due to its size.

The base includes at least one aperture for receiving a fastener to be mounted to, for example, a bus board. In some embodiments, the base includes two apertures so that it is more securely mounted on the bus board.

In a preferred embodiment, the lug includes an aperture for receiving the wire, and a threaded aperture and a set screw (or other types of securing mechanisms), associated with the aperture for receiving the wire. The lug may also be configured to receive two wires, and, thus include a second aperture for receiving a wire and a second threaded aperture with a second set screw. Any of these apertures may be chamfered to facilitate insertion of the wires/set screws into the apertures.

The set screw may include a threaded shaft and a head. The head may include a projected hexagonal configuration.

As previously mentioned, the lug and the base are rotationally coupled. As used herein, rotationally coupled means that the lug can be rotated in relation to the base. In other words, the base is secured to the bus board and is held in a set position. The lug, on the other hand, can rotate, horizontally, vertically or at an angle having a horizontal and vertical component, to receive a wire.

In a preferred embodiment, the lug and the base portion include complementarily configured coupling faces, and preferably gear faces. The gear faces each include an aperture extending there through to receive a connecting member. The gear faces increase the strength of the couple between the lug and the base. In addition, it increases the surface area between the lug and the base and provides for a better connection.

The coupling face of the base may be slightly concave and the coupling face of the lug may be slightly convex. Alternatively, the coupling face of the base may be slightly convex and the coupling face of the lug may be slightly concave. This type of orientation increases the self centering forces between the lug and the base.

It is preferred that the connecting member is a bolt. The bolt may include a compression washer, and the compression washer may be integral to the bolt. Where the connecting member is a bolt it is contemplated that at least one of the apertures in the coupling faces is threaded (preferably at least the aperture in the coupling face of the base).

It is also preferred that the base and the lug are made from a high strength aluminum alloy, such as 6061-T6. It is likewise preferred that the set screws and connecting members are manufactured from aluminum, such as 6262-T9. In addition, it is contemplated that one of more of these components is tin plated.

In use, it is contemplated that an electrical joint compound, such as PENETROX A, is utilized.

A device accordingly to one or more embodiments is believed to be beneficial for numerous reasons.

First, such a device would increase the speed at which wires could be coupled to bus boards. Instead of precisely bending the wire to meet the electrical connector, the connector can be rotated or moved to accommodate the wire. The decrease in time, and labor, would result in saving resources.

Second, such a device would eliminate the need for a bend in the wire, as it is the electrical connector that is rotated to meet the wire. In addition to saving time and resources, this would avoid adding stress not only on the conductive elements of the wire, but also on the nonconductive coating of the wire.

Third, such a device would allow for a plurality of configurations as base units and lugs that could be used interchangeably with each other.

These and other benefits of the present invention will become readily apparent to those of ordinary skill in the art with this disclosure and the attached drawings before them.

BRIEF DESCRIPTION OF THE DRAWINGS

The present invention will become more fully apparent from the following description and appended claims, taken in conjunction with the accompanying drawings. Understanding that the accompanying drawings depict only typical embodiments, and are, therefore, not to be considered to be limiting of the scope of the present disclosure, the embodiments will be described and explained with specificity and detail in reference to the accompanying drawings as provided below.

FIG. 5 is a top perspective view of an embodiment of a base according to the present invention.

FIG. 6 is a top perspective view of an embodiment of a base according to the present invention.

FIG. 7 is a top perspective view of an embodiment of a base according to the present invention.

FIG. 8 is a top perspective view of an embodiment of a base according to the present invention.

FIG. 9 is a top perspective view of an embodiment of a lug according to the present invention.

FIG. 10 is a top perspective view of an embodiment of a lug according to the present invention.

FIG. 11 is a top perspective view of an embodiment of a lug according to the present invention.

FIG. 12 is a top perspective view of an embodiment of a lug according to the present invention.

FIG. 13 is a top perspective view of an embodiment of a lug according to the present invention.

FIG. 14 is a top perspective view of an embodiment of a lug according to the present invention.

FIG. 15 is a side perspective view of a connecting member according to the present invention.

FIG. 16 is a side perspective view of a set screw according to the present invention.

FIG. 17 is a top perspective view of an embodiment of a lug according to the present invention.

DETAILED DESCRIPTION

Figure 1:
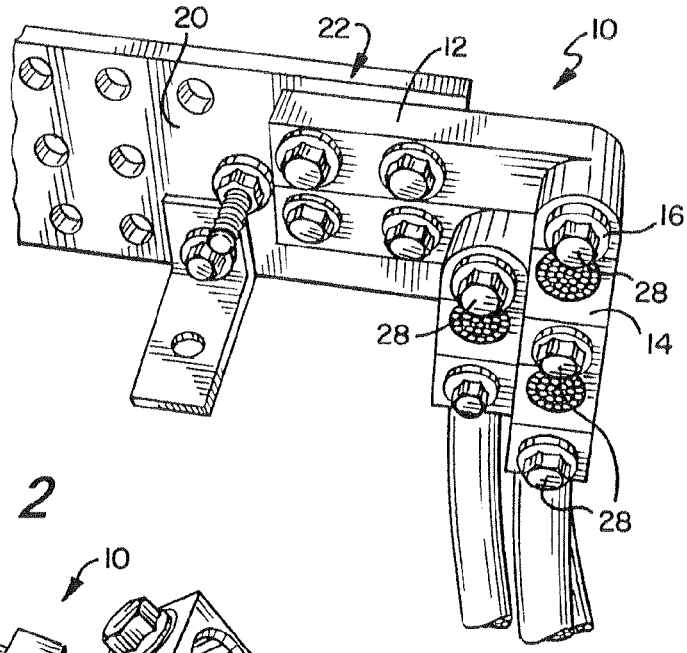
FIG. 1 is a perspective side view of a first base coupled to a lug according to an embodiment of the present invention and a second base coupled to a second lug according to an embodiment of the present invention.
Figure 2:
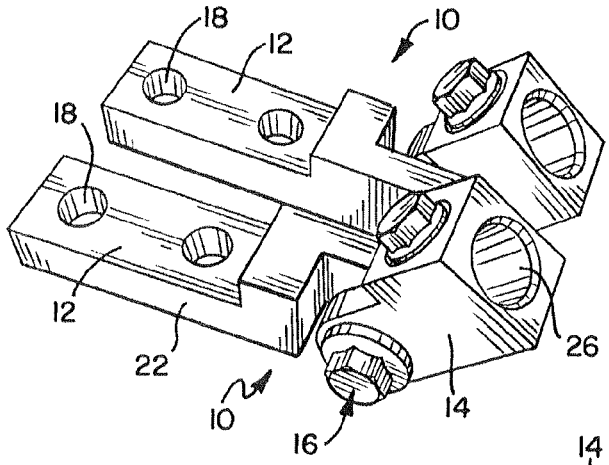
FIG. 2 is a perspective top view of a first base coupled to a lug according to an embodiment of the present invention and a second base coupled to a second lug according to an embodiment of the present invention.

It will be readily understood that the components of the embodiments as generally described and illustrated in the drawings herein could be arranged and designed in a wide variety of different configurations. Thus, the following more detailed description of various embodiments, as represented in the drawings, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

In FIG. 1, an electrical connector 10 according to the present invention includes a base 12, a lug 14, and a connecting member 16 for rotationally coupling the base 12 to the lug 14.

The base 12 includes at least one aperture 18 therein for mounting on a bus board 20. Preferably, the base 12 includes two apertures 18 for mounting on a bus board 20. The base 12 may include a notched portion 22 to accommodate mounting the base 12 on the bus board 20.

The base 12 also includes a coupling face 24 for coupling to the lug 14.

Figure 4:
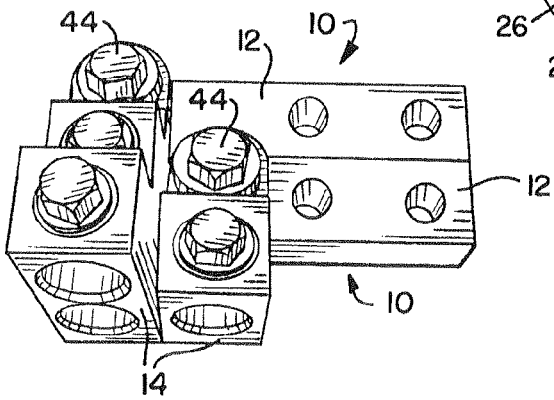
FIG. 4 is another perspective side view of a first base coupled to a lug according to an embodiment of the present invention and a second base coupled to a second lug according to an embodiment of the present invention.

The lug 14 includes at least one aperture 26 for receiving a wire 28, although in some embodiments, the lug 14 includes two apertures 26, each for receiving a wire 28. (See, FIG. 4). It is preferred that the aperture 26 is chamfered to allow easier insertion of the wire 28. The lug 14 also includes a threaded aperture 30 and a set screw 32 cooperating with aperture 26 for receiving the wire 28. Although a set screw has been identified, any other type of conventional securing/fastening member or structure that will positionally secure the wire in place is also contemplated for use.

Finally, the lug 14 includes a coupling face 34 configured complementary to the coupling face 24 of the base 12.

It is preferred that the coupling face 34 of the lug 14 and the coupling face 24 of the base 12 are geared coupling faces 36, 38. The geared faces 36, 38 prevent movement or rotation of the lug 14 when the wire 28 is coupled thereto (which exerts a force on the lug 14). In addition, the geared faces 36, 38 increase the surface area between the lug 14 and the base 12 to improve and increase electrical connectivity.

It is preferred that one of the coupling faces 24, 34 is concave and the other is convex. The concave/convex coupling faces 40, 42 can be geared faces 36, 38, or, alternatively can be non-geared faces. The concave/convex coupling faces 40, 42 provide a self centering function to assist in coupling the base 12 and the lug 14 together. In addition, the concave/convex faces 40, 42 lead to a lower heat interaction between the base 12 and the lug 14.

As discussed above, the electrical connector 10 of the present invention includes a connecting member 16. This preferably is a bolt 44. The bolt 44 connects the lug 14 and the base 12 by screwing into a threaded aperture 46 located on the coupling face 24 of the base 12. In addition, to receive the bolt 44, the coupling face 34 of the lug 14 also includes an aperture 48—which may be threaded, or it may be smooth. Utilizing a smooth aperture 48 increases the speed and the ease of coupling the lug 14 and the base 12 together; however, as noted, it can be threaded as well.

The bolt 44 may also include a compression washer 50, which may be integral therewith. The compression washer 50 exerts a force, after it is tightened, to assist in maintaining the coupling of the lug 14 and the base 12.

Figure 3:
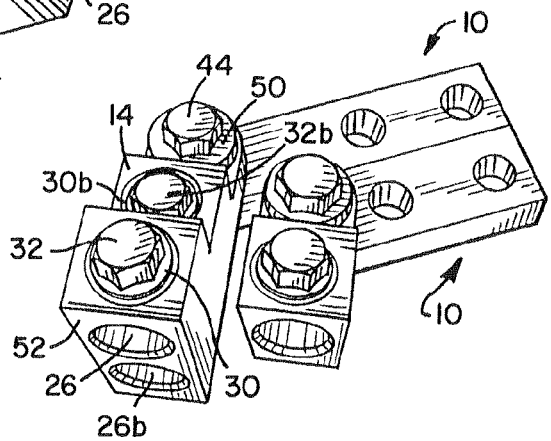
FIG. 3 is another perspective side view of a first base coupled to a lug according to an embodiment of the present invention and a second base coupled to a second lug according to an embodiment of the present invention.

As is shown in the drawings certain embodiments of the invention disclose a lug 52 that has a second aperture 26*b* therein for receiving a second wire, a second threaded aperture 30*b* and a set screw 32*b* cooperating with the second aperture 26*b* of the lug 52 to retain the second wire. (See, FIG. 3).

As discussed, a preferred embodiment of the invention utilizes a securing member, such as set screw 32 to couple the wire 28 to the lug 14. It is preferred that the body 54 of the set screw 32 is larger than the head 56 of the set screw 32. This will allow the set screw 32 to be rotated into the aperture 26 such that the head 56 may enter the aperture 26 and secure the wire 28. Further, it is contemplated that the end 58 of the set screw 32 opposite the head 56 is slightly pointed (as opposed to flat) to allow the set screw 32 to better hold the wire 28 in the aperture 26.

It is also preferred that the head 56 of the set screw 32 is a standard ⅝ size projected hexagonal configuration. Unlike other electrical connectors, this does not require a tool to be inserted into the head 56 of the set screw 32. Rather, a tool can engage about the projected hexagonal configuration. This would be beneficial in instances where there is limited space for engaging the head 56 of the set screw 32. Again, while the use of set screws has been identified for use, it will be readily understood by those with ordinary skill in the art that any other type of conventional fastening member that enables positional securement of the wires within respective apertures, can alternatively be used.

The various embodiments of the bases and lugs shown throughout the attached drawings are interchangeable, allowing for various configurations to be created to allow an electrical connector that rotates right and left (relative to the bus board) or up and down (relative to the bus board), or at an angle (relative to the bus board).

Accordingly, in some of the embodiments, the aperture 18 of the base 12 for mounting includes a longitudinal axis, and the coupling face 24 of the base 12 lies in a plane relatively perpendicular to the longitudinal axis of the aperture 18 of the base 12. (See, FIGS. 5 and 6). Alternatively, the coupling face 24 of the base 12 lies in a plane relatively parallel to the longitudinal axis of the aperture 18 of the base 12. (See, FIGS. 7 and 8).

Similarly, with respect to the lug 14, the aperture 26 of the lug 14 includes a longitudinal axis, and the coupling face 34 of the lug 14 can lie in a plane relatively perpendicular to the longitudinal axis of the aperture 26 (See, FIGS. 10 and 13) or in a plane relatively parallel to the longitudinal axis of the aperture 26. (See, FIGS. 9, 11, 12 and 14).

In one embodiment shown in FIG. 5, the base 60 has a length of 4.45 inches and a width of 1.375 inches. The coupling face 62 has a diameter of 1.375 inches and is a geared face with 44 teeth and a 0.0478 inch deep concave configuration. In the embodiment shown in FIG. 6, the base 64 has the same dimensions except that the length is 5.875 inches. The two embodiments shown in FIGS. 5 and 6 are advantageous as they can be mounted adjacent on a bus board 20 as shown in FIG. 1, and allow two lugs (one connected to each base) to rotate up and down (relative to the bus board).

In another embodiment shown in FIG. 7, the base 66 has a length of 5.5 inches and a width of 1.375 inches. The coupling face 68 has the same dimensions as the embodiments shown in FIGS. 5 and 6. The embodiment of the base 70 shown in FIG. 8 is a minor image of the base 66 in FIG. 7, and thus, has the same measurements. The bases 66, 70 shown in FIGS. 7 and 8 allow the lug to move right to left (relative to the bus board).

In an embodiment according to the present invention as shown in FIG. 9, the lug 72 has a length of 3.0 inches and a width of 1.75 inches. The coupling face 74 has a diameter of 1.375 inches and is a geared face with 44 teeth and a 0.0478 inch deep convex configuration. The lug 76 shown of FIG. 11, is a minor image of the lug 72 of FIG. 9, and thus has the same dimensions. Further, the lug 78 shown of FIG. 10 has a length of 2.97 inches, and the remaining dimensions are the same as the embodiments in FIGS. 9 and 11. The different lugs 72, 76, 78 can be coupled to the various bases to provide a multitude of rotatable electrical connectors that can rotate in various directions to receive the wire.

In the embodiments shown in FIGS. 12-14, the lugs 80*a*, 80*b*, 80*c* include two apertures each one for receiving a wire. These embodiments have an overall length of 4.34 inches and a height of 3.0 inches.

While these dimensions of the various embodiments have been provided, the dimensions are merely provided to aide one of skill in the art in practicing the present invention and should no way be interrupted as limiting the present invention.

Without further elaboration, it is believed that one skilled in the art can use the preceding description to utilize the present disclosure to its fullest extent. The examples and embodiments disclosed herein are to be construed as merely illustrative and not a limitation of the scope of the present disclosure in any way. It will be apparent to those having skill in the art that changes may be made to the details of the above-described embodiments without departing from the underlying principles of the disclosure provided herein. In other words, various modifications and improvements of the embodiments specifically disclosed in the description above are within the scope of the appended claims. Note that elements recited in means-plus-function format are intended to be construed in accordance with 35 U.S.C. §112¶6. The scope of the invention is therefore defined by the following claims.

The invention claimed is:

1. An electrical connector comprising:

a base having at least one aperture for mounting the base to a bus board and a coupling face;

a lug having at least one aperture for receiving a wire, a threaded aperture with a set screw cooperating with the at least one aperture for receiving the wire, and a coupling face configured complementary to the coupling face of the base; and a connecting member for coupling the base to the lug, wherein the lug is rotationally coupled to the base.

2. The electrical connector of claim 1, wherein the coupling face of the lug and the coupling face of the base are geared coupling faces.

3. The electrical connector of claim 2 wherein one of the coupling faces is concave and the other is convex.

4. The electrical connector of claim 1 wherein one of the coupling faces is concave and the other is convex.

5. The electrical connector of claim 1 wherein the connecting member includes an integral compression washer.

6. The electrical connector of claim 1 wherein the lug includes a second aperture for receiving a second wire, a second threaded aperture with a second set screw cooperating with the second aperture for receiving the second wire.

7. The electrical connector of claim 1 further comprising, the at least one aperture of the base having a longitudinal axis, and the coupling face of the base lying in a plane relatively perpendicular to the longitudinal axis of the at least one aperture of the base.

8. The electrical connector of claim 1 further comprising, the at least one aperture of the base having a longitudinal axis, and the coupling face of the base lying in a plane relatively parallel to the longitudinal axis of the at least one aperture of the base.

9. The electrical connector of claim 1 further comprising, the at least one aperture of the lug having a longitudinal axis, and the coupling face of the lug lying in a plane relatively perpendicular to the longitudinal axis of the at least one aperture of the lug.

10. The electrical connector of claim 1 further comprising, the at least one aperture of the lug having a longitudinal axis, and the coupling face of the lug lying in a plane relatively parallel to the longitudinal axis of the at least one aperture of the lug.

11. The electrical connector of claim 1 wherein the coupling faces each include an aperture for receiving the connecting member.

12. The electrical connector of claim 11 wherein at least one of the apertures in the coupling faces is threaded.

13. An electrical connector comprising:

a base having two apertures for mounting the base to a bus board and a geared coupling face;

a lug having at least one aperture for receiving a wire and a positional fastening member associated with the aperture for securing the wire at a desired location within the aperture, and a geared coupling face configured complementary to the geared coupling face of the base; and a bolt for coupling the base to the lug, wherein the geared coupling faces each include an aperture to receive the bolt and wherein at least one of the apertures in the geared coupling faces is threaded, wherein the lug is rotationally coupled to the base.

14. The electrical connector of claim 13 wherein one of the geared coupling faces is concave and the other is convex.

15. The electrical connector of claim 14 wherein each geared coupling faces includes 44 teeth.

16. The electrical connector of claim 13 wherein the lug includes a second aperture for receiving a second wire, a second aperture with a second fastening member cooperating with the second aperture for positionally securing the second wire therein.

* * * * *